United States Patent [19]

Maag

[11] Patent Number: 4,883,270

[45] Date of Patent: Nov. 28, 1989

[54] FOUR-BAR VARIABLE-RESISTANCE FRONTAL CALF DEVELOPING MACHINE

[76] Inventor: Henry H. Maag, 5332 Clark Cir., Westminster, Calif. 92683

[21] Appl. No.: 308,192

[22] Filed: Feb. 9, 1989

[51] Int. Cl.[4] ..... A63B 21/00

[52] U.S. Cl. ..... 272/134; 272/118; 272/96

[58] Field of Search ..... 272/134, 118, 117, 96

[56] References Cited

U.S. PATENT DOCUMENTS

| | | | |
|---|---|---|---|
| 3,020,046 | 2/1962 | Hotas | 272/96 |
| 3,116,062 | 12/1963 | Zinkin | 272/134 |
| 3,917,262 | 11/1975 | Salkeld | 272/134 |
| 4,336,934 | 6/1982 | Hanagan et al. | 272/117 |
| 4,337,939 | 3/1982 | Hoyle et al. | 272/96 |
| 4,357,010 | 11/1982 | Telle | 272/117 |
| 4,452,447 | 6/1984 | Lepley et al. | 272/96 |
| 4,577,861 | 3/1986 | Bangerter et al. | 272/96 |
| 4,605,220 | 8/1986 | Troxel | 272/96 |
| 4,822,038 | 4/1989 | Maag | 272/134 |

*Primary Examiner*—Richard J. Apley
*Assistant Examiner*—J. Welsh

[57] ABSTRACT

A frontal calf exercising machine which utilizes a frame-journaled rotating foot-engaging assembly to apply resistive force couples to the tops of an operator's feet and bottoms of his heels through circular paths about the axes of rotation of his ankle joints. This frame-journaled rotating foot-engaging assembly is mechanically linked to a frame-journaled rotating weight arm, which, together with the frame of the machine and the connecting link joining them, form a simple planar double-rocking-lever four-bar linkage which acts in conjunction with the rotating weight arm to vary the resistive force applied to the dorsi-flexing muscles of the operator's feet through body-machine contact between the operator's feet and the rotating foot-engaging assembly throughout the range of the exercise movement.

2 Claims, 4 Drawing Sheets

FOUR-BAR VARIABLE-RESISTANCE FRONTAL CALF DEVELOPING MACHINE

This invention relates to exercise equipment, in particular to an exercise machine which develops an operator's frontal calf muscles, through applying variably resistive force couples to the tops and heels of the operator's respective feet through circular paths about the operator's ankle joints throughout the range of the exercise movement.

BACKGROUND OF THE INVENTION

Frontal calf developing machines (what few there are) are all designed to exercise an operator's frontal calf muscles through applying force couples to the operator's feet which tend to rotate the feet about the ankle axes in the direction of plantar flexion of the feet. The frontal calf muscles are developed during the exercise as they oppose these applied force couples by rotating the feet in the direction of dorsal flexion.

SUMMARY OF THE INVENTION

The disclosed invention consist of a stable frame which includes provision for supporting an operator in a seated position of operation. Journaled in this frame, on a horizontal axis which is approximately common with the axes of rotation of the operator's ankle joints, is a rotating foot-engaging assembly which includes body-machine force-transmitting contact surfaces which engage both the tops and heels of the operator's feet and apply resistive force couples to each foot while performing the exercise. Also journaled in the machine's frame on an axis which is both parallel with and offset by a specific distance from the axis of rotation of the rotating foot-engaging assembly, is a rotating weight arm which, as its name indicates, contains a means for loading weights onto at a point offset from its axis of rotation (as by means of either a selectorized weight stack as shown in the disclosure or a conventional horizontal plate recieving bar). The rotating foot-engaging assembly and the rotating weight arm are mechanically linked to each other at axes which are both parallel with an offset by specific distance from their respective axes of rotation by a rigid connecting link which also has a specific length between its centers of connection. These two rotating assemblies, the link joining them, and the frame of the machine join together to form a simple planar double-rocking-lever four-bar linkage which acts in conjunction with the rotating weight arm to vary the resistive force couples applied to the operator's feet through body-machine contact between the rotating foot-engaging assembly and the operator's feet throughout the exercise movement. Through a simple kinematic analysis, the specific lengths and orientations of the moving parts which constitute the four-bar linkage / rotating weight arm force-varying mechanism can be specified to apply a load, at the foot-engaging contact surfaces on the rotating foot-engaging assembly, which varies in accordance with the normal strength-to-position force-applying capabilities of the average operator in the dorsi-flexion exercise movement of the feet.

DESCRIPTION OF THE PREFERRED EMBODIMENT

Figure 1:
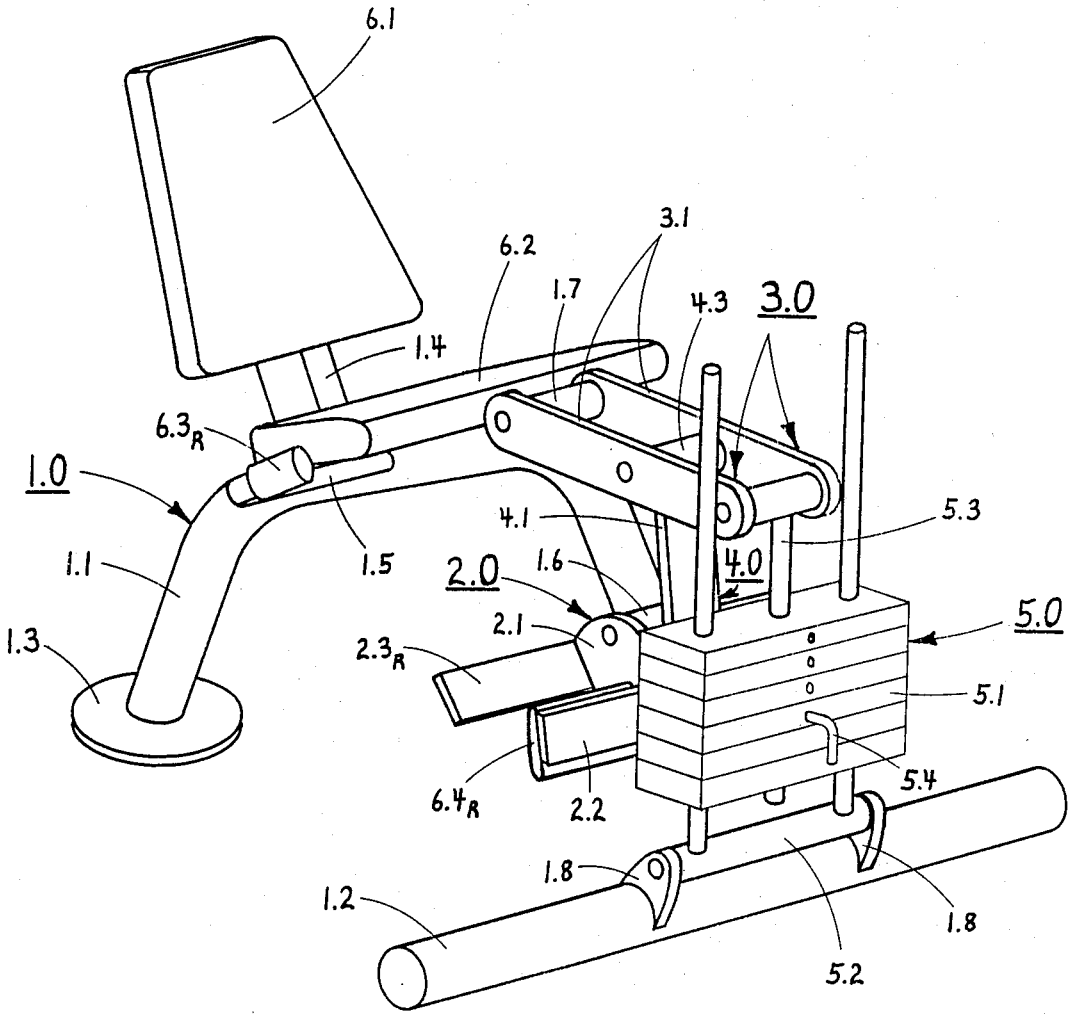
FIG. 1 is a pictorial view of the preferred configuration embodiment of the disclosed frontal calf developing machine with all parts labeled.
Figure 2:
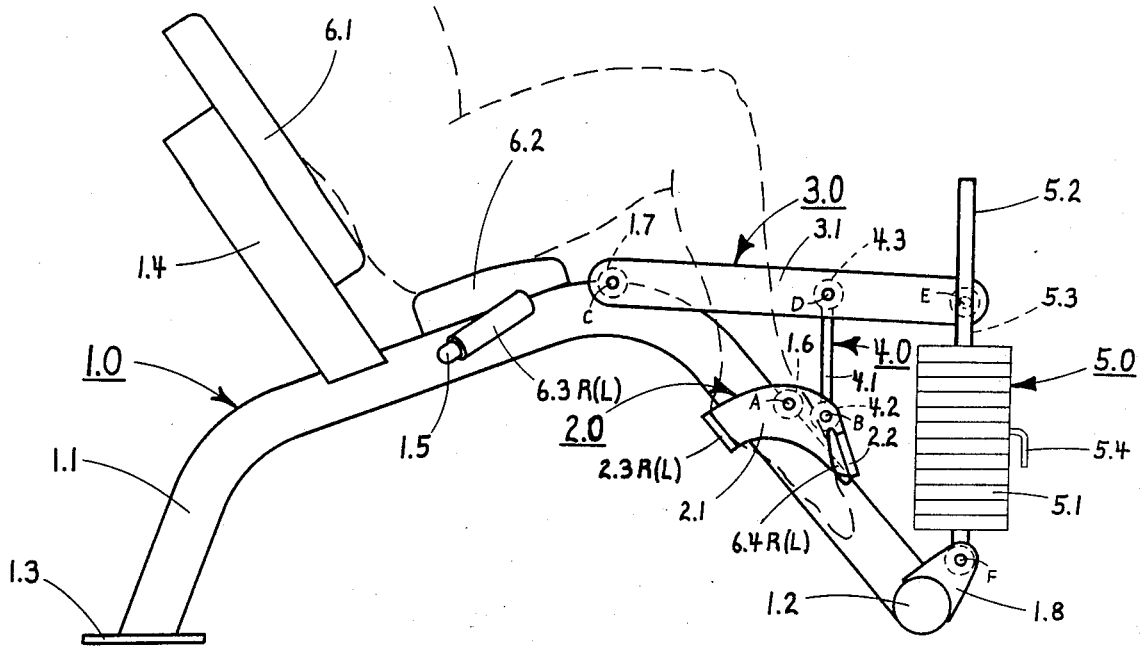
FIG. 2 is a side (plan) view of the preferred configuration embodiment of the disclosed frontal calf developing machine with all parts labeled.

Refer now to FIGS. 1 & 2 which shown corresponding pictorial and side views of the preferred configuration embodiment of the disclosed invention. In general the frame of the machine is constructed primarily of round steel tubing which is welded together at the junctions where the tubes meet as shown. Welded to this tubular steel frame are steel flanges or steel bearing tubes for journaling the bearings for the moving parts and steel tabs for attaching padded body-machine contact surfaces. As shown in FIGS. 1 & 2, the primary frame of the invention (assembly 1.0) consist of an irregularly shaped bent round steel tube (part 1.1) which lies on the machine's plane of symmetry and joins perpendicularly into the center of a second transverse straight round steel tube (part 1.2) at its forward end. Joined to the rear open end of part 1.1 is a small round steel plate (part 1.3) which lies on the ground plane and together with part 1.2 at the forward end of the machine forms a stable triangular base for the machine. Centered on the machine's plane of symmetry and joined into the top side just in front of the top of the rear bend on part 1.1 is a short straight rectangular steel tube (part 1.4) which mounts an operator back support pad (part 6.1) which engages and constains the operator's back while performing the exercise. Also centered on the machine's plane of symmetry in a position below and just in front of the back support pad is an operator seat support pad (part 6.2) which acts in conjunction with the back support pad to support the operator's body while performing the exercise. Mounted transversely through part 1.1 in a position at approximately the rear of the seat support pad is a handlebar (part 1.5) which mounts a pair of handgrips (parts $6.3_R$ & $6.3_L$) in positions where they can be gripped by the operator while performing the exercise.

Figure 3:
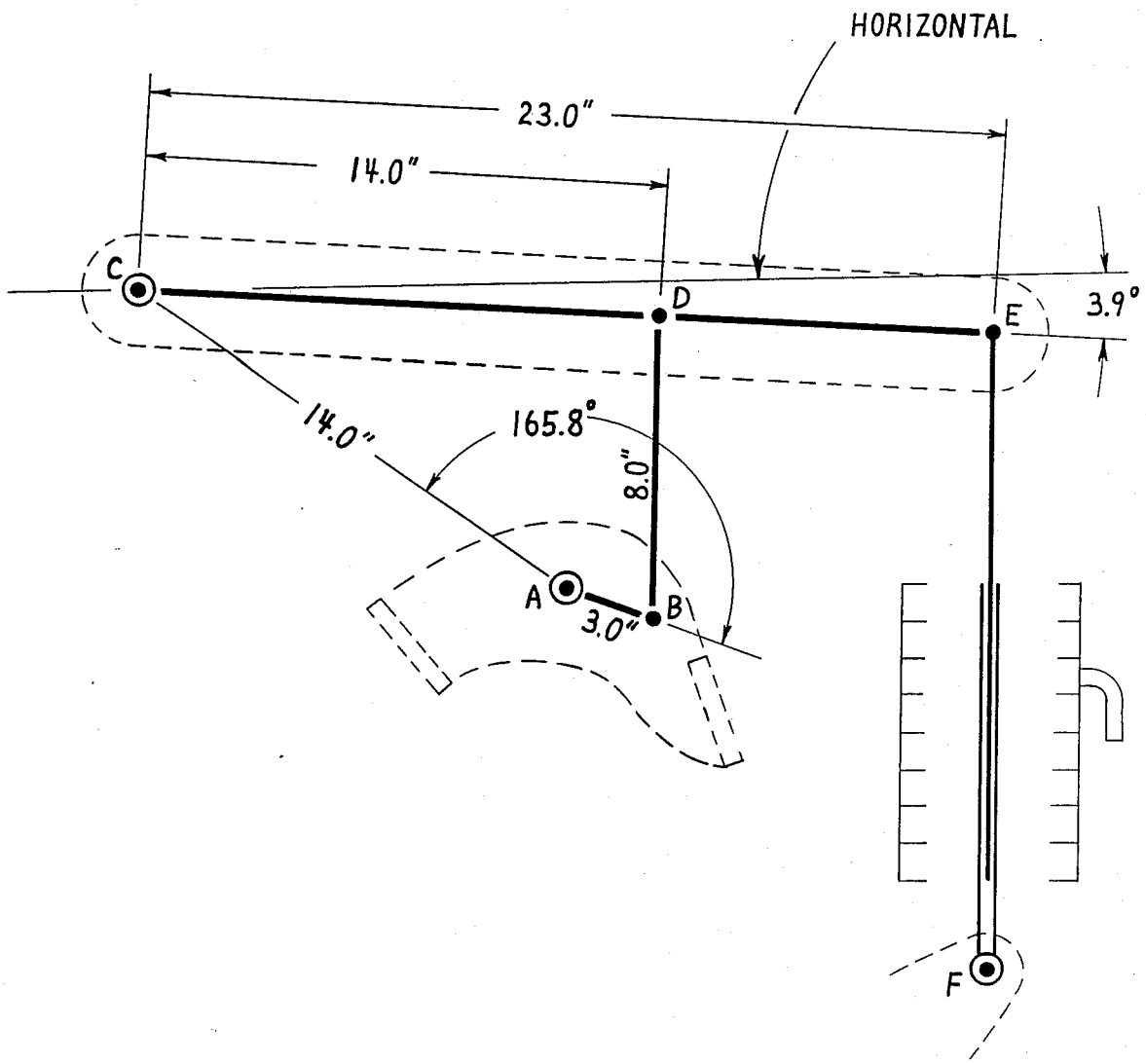
FIG. 3 is a kinematic view of the moving parts of the disclosed frontal calf developing machine taken perpendicular to the plane in which they move showing all critical dimensions and angles at the starting position of the exercise movement.

Centered about the machine's plane of symmetry is a rotating foot-engaging assembly (assembly 2.0) which rotates about an axis (axis A) which is both parallel with the ground plane and positioned to be approximately common with the axes through the operator's ankle joints while in the operating position. This rotating footengaging assembly is pivotally mounted to the machine's frame by a steel shaft which is centered on axis A in bearings which are journaled in a frame-attached bearing tube (part 1.6) which is located on the upper forward side of the forward straight section of part 1.1 in a position between the operator's ankle joints while in the operating position. It is composed of two parallel irregularly shaped steel plates (parts 2.1) which join into a transverse flat steel bar (parts 2.2) at their upper forward ends. This transverse flat steel bar (part 2.2) mounts a pair of right and left top-of-the-foot engaging pads (parts $6.4_R$ & $6.4_L$, respectively) which are positioned to engage the tops of the operator's corresponding right and left feet while in the operating position with the operator's ankle axes common with the axis of rotation of the rotating foot-engaging assembly (axis A). Joined to the lower rearward end of each respective part 2.1 is a respective short transverse flat steel bar (part $2.3_R$ or $2.3_L$) which extends transversely outward from the lower rearward end of the corresponding part 2.1 to a position where it will engage the bottom side of the operator's corresponding right or left heel while in the operating position. A pair of colinear holes which journal the steel shaft which mounts the rotating footengaging assembly to the machine's frame at axis A are drilled in parts 2.1 in positions corresponding with the axes of ratation of the operator's ankle joints. Parallel with and offset by 3.0" from this pair of colinear holes on axis A are a second pair of colinear holes, also drilled in parts 2.1, which journal a second steel shaft on axis B which is used in connecting a connecting link from the rotating foot-engaging assembly (assembly 2.0) to the rotating weight arm assembly (assembly 3.0). As shown in FIG. 3, the direction to axis B from axis A is along a line which forms a 165.8° angle with the line connecting axis A with axis C at the beginning of the exercise movement.

As shown in FIGS. 1 & 2, this invention contains a rotating weight arm assembly (assembly 3.0) which rotates about an axis (axis C) which is both parallel with and offset by 14.0" from the axis of rotation of the rotating foot-engaging assembly (assembly 2.0, axis A). Like the rotating foot-engaging assembly, this rotating weight arm assembly is also centered about the machine's plane of symmetry and pivotally mounted to the machine's frame by a steel shaft which is centered on axis C in bearings which are journaled in a frame-attached bearing tube (part 1.7) which is located at the top of the upper bend portion of part 1.1 in a position just in front of the seat support pad (part 6.2). It is composed simply of two parallel flat steel bars (parts 3.1) which, together, contain three pairs of colinear holes, the first pair of which are drilled through their rearward ends and which journal the steel shaft which mounts the assembly to the machine's frame at axis C, the second pair of which are drilled through their middle sections and which journal a steel shaft which is used in connecting the connecting link mentioned earlier from the rotating foot-engaging assembly to the rotating weight arm assembly at axis D, and the third pair of which are drilled through their forward ends and which journal a steel shaft which mounts a selectorized weight stack assembly (assembly 5.0) at axis E. Axes C, D, & E are all parallel and all lie on the same line when viewed from the side (as shown in FIG. 2). As shown in FIG. 3, axis C and Axis D are separated by a distance of 14.0" and axis C and axis E are separated by a distance of 23.0". The selectorized weight stack assembly (assembly 5.0) is composed of the standard rocking weight supporting rod with spaced apertures (part 5.3) which is pivotally mounted to the rotating weight arm by the steel shaft at axis E and which extends down through a set of vertically stacked weights (parts 5.1) which are free to move up and down a rocking guide assembly (part 5.2) which is pivotally attached to the front of the machine's frame in frame-attached flanges (parts 1.8) at axis F and which extends upward through the set of vertically stacked weights. As is conventional, a desired quantity of weights can be quickly and easily mechanically joined to part 5.3 by operator manipulation of a weight engaging key pin (part 5.4) which extends through a selected aperture in the set of weights into a mating aperture in the pivotal weight supporting rod (part 5.3). The angle formed between the line connecting axis E with axis C and the horizontal line passing through axis C is 3.9° below horizontal at the beginning of the exercise movement as shown in FIG. 3.

As shown in FIGS. 1 & 2, the two rotating assemblies on this machine (assemblies 2.0 & 3.0) are mechanically linked to each other by a rigid steel connecting link (assembly 4.0). This connecting link assembly is simply composed of a rigid steel bar (part 4.1) which joins between a pair of parallel bearing tubes (parts 4.2 & 4.3). The connecting link's lower bearing tube (part 4.2) journals a pair of bearings which engage the steel shaft mounted in the rotating foot-engaging assembly at axis B and the connecting link's upper bearing tube (part 4.3) journals a pair of bearings which engage the steel shaft mounted in the rotating weight arm assembly at axis D. The distance between the axes of the connecting link's upper and lower bearing tubes (axes B & D) is 8.0" as shown in FIG. 3.

Figure 4:
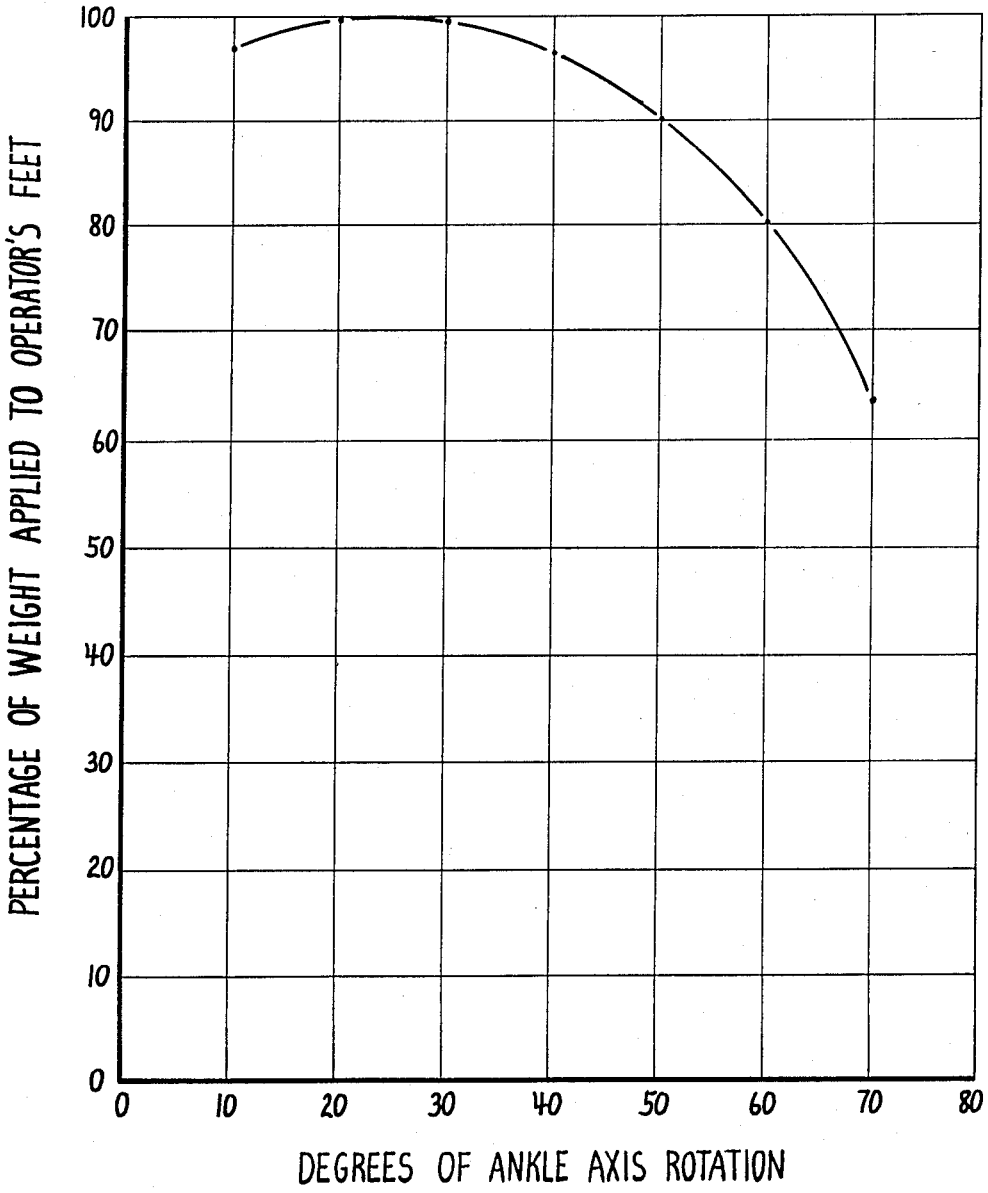
FIG. 4 is a graph generated from kinematic analysis of the force-varying mechanism composed of the moving parts shown in FIG. 3.

When the rotating foot-engaging assembly (assembly 2.0) is in its starting position (which should correspond with the operator's feet being in the completely plantar flexed position - bottom of feet forming about a 70° angle with the tibea bones) and all angles and distances for the force-varying mechanism are as shown in FIG. 3 the corresponding output shown in the graph in FIG. 4 will be obtained while performing the exercise.

HOW THE INVENTION WORKS

As shown in FIGS. 1 & 2, this invention utilizes two rotating bodies which are journaled in a common frame and joined to each other by a rigid connecting body. These two rotating bodies (the rotating foot-engaging assembly—assembly 2.0 and the rotating weight arm assembly - assembly 3.0), the frame of the machine (assembly 1.0), and the rigid connecting body (the connecting link - assembly 4.0) join to form a simple planar double-rocking-lever four-bar linkage. This four-bar linkage, whose members'lengths and orientations are as described in FIG. 3, when acting in conjunction with the sinusoidally changing values of force applied by the machine's rotating weight arm as the weight applied at axis E swings through a circular path through the gravitational field, applies, to the operator's frontal calf muscles, through body-machine contact between the rotating foot-engaging assembly and the operator's feet throughout the range of the exercise movement, the variably resistive force shown in the graph in FIG. 4.

CONCLUSION

This invention applies resistive force couples to an operator's feet which vary as a function of the degrees of rotation of the operator's ankle joints throughout the range of dorsal flexion of the feet. These variably resistive force couples are obtained through the use of a kinematically derived and specified four-bar linkage acting in conjunction with a rotating weight arm which, together, have been designed to vary these resistive force couples to correspond to the normal strength-to-position force applying capabilities of the average operator's frontal calf muscles. The rotating weight arm-/four-bar linkage force-varying mechanism consist of only three moving parts connected to each other and to the frame of the machine at a total of four pivotal joints making the machine inherently reliable, quiet, and friction free. In addition, because the machine uses no members which go through any cyclic bending (as is the case with a machine using cables) the problems associated with fatigue wear are eliminated making the machine's moving parts essentially maintainence free.

Having thus described the invention and its function, what is claimed is as follows:

1. A frontal calf exercising machine, comprising:

a rigid frame which includes means for supporting an operator in a seated position of operation;

a rigid rotating foot-engaging assembly which is journaled in said frame on an axis which is approximately common with the axes of rotation of said operator's ankle joints while said operator is supported in said machine's frame in the operating position;

said rigid rotating foot-engaging assembly includes both top and heel-of-the-foot engaging surfaces which, through body-machine contact, apply resistive forces to the respective tops and heels of the operator's feet through circular paths about the rotational axes of the operator's ankle joints;

a rigid rotating weight arm which is journaled in said machine's frame on an axis which is both parallel with and separated by a specific distance from the axis of rotation of said rigid rotating foot-engaging assembly;

said rigid rotating weight arm includes means for loading weights onto at a point offset from its axis of rotation;

said rigid rotating foot-engaging assembly and said rigid rotating weight arm are mechanically linked to each other at axes which are both parallel with and offset by specific distances from their respective axes of rotation by a rigid connecting link which has a specific length between its centers of connection;

said rigid rotating foot-engaging assembly, said rigid rotating weight arm, said link mechanically joining said rigid rotating foot-engaging assembly and said rigid rotating weight arm, and said frame of said frontal calf exercising machine join together to form a four-bar linkage which, when acting in conjunction with the sinusoidally changing values of force applied by the machine's rotating weight arm as the applied weight swings through a circular path through the gravitational field, applies a predetermined variably resistive force at the top and heel-of-the-foot engaging surfaces on said rigid rotating foot-engaging assembly, which varies as a function of the degrees of rotation of the operator's ankle joints and which is characteristic of the releationships in length and orientation of the four rigid members forming the four-bar linkage and the orientation of the rotating weight arm to the gravitational field throughout the range of the exercise movement;

said specific distance between the axis of rotation of said rigid rotating foot-engaging assembly and the axis of rotation of said rigid rotating weight arm, said specific distance between the axis of rotation of said rigid rotating foot-engaging assembly and the axis of connection of said connecting link on said rigid rotating foot-engaging assembly, said specific distance between the axis of rotation of said rigid rotating weight arm and the axis of connection of said connecting link on said rigid rotating weight arm, and said specific distance between the centers of connection on said connecting link all have a definite non-changing relationship to each other, which relationship, along with their orientations to each other, is determined through kinematic analysis of the moving parts of the four-bar linkage age/rotating weight arm force-varying mechanism and is dependent on said predetermined variably resistive force which said four-bar linkage / rotating weight arm force-varying mechanism is designed to put out throughout the exercise movement.

2. The frontal calf exercise machine of claim 1, in which said means for loading weights onto said rotating weight arm at a point offset from its axis of rotation consist of a weight supporting means which is pivotally connected to said rotating weight arm at said point offset from said rotating weight arm's axis of rotation and which extends approximately vertically downward through a plurality of weights which are slideably mounted to a rocking guide assembly which is pivotally mounted to said machine's frame so that said weights may move vertically up and down said rocking guide assembly relative to said frame and whereby a predetermined number of said weights may be mechanically attached to said weight supporting means for movement therewith.

* * * * *